United States Patent [19]

Odinokov et al.

[11] 4,199,192

[45] Apr. 22, 1980

[54] METHOD OF MINING BEDDED MINERAL DEPOSITS WITH HYDRAULIC EXTRACTION

[76] Inventors: Boris P. Odinokov, ulitsa Chernomorskaya 2, kv. 21; Anatoly Y. Semenikhin, ulitsa Transportnaya 97, kv. 55; Gavriil A. Pakhtusov, prospekt Pionersky 46, kv. 225; Jury G. Pakhtusov, ulitsa Transportnaya 61, kv. 111; Anatoly E. Sankov, ulitsa Ushinskogo 8, kv. 14, all of Novokuznetsk, U.S.S.R.

[21] Appl. No.: 881,385

[22] Filed: Feb. 27, 1978

[51] Int. Cl.[2] ..... E21C 45/00

[52] U.S. Cl. ..... 299/17; 299/19

[58] Field of Search ..... 299/17–19

[56] References Cited

U.S. PATENT DOCUMENTS

| | | | |
|---|---|---|---|
| 796,499 | 8/1905 | Claghorn | 299/18 |
| 957,364 | 5/1910 | O'Toole et al. | 299/18 |
| 1,276,952 | 8/1918 | O'Toole | 299/19 X |
| 2,358,687 | 9/1944 | Cassidy et al. | 299/19 X |

FOREIGN PATENT DOCUMENTS

| | | | |
|---|---|---|---|
| 284938 | 1/1971 | U.S.S.R. | 299/17 |

OTHER PUBLICATIONS

"Hydraulic Mining of Coal", by Parkes & Grimley Mining Congress-Journal, pp. 26–29, May–1975.

"Hydraulic Mining", Mitsui Mining, Ltd., 14 pages.

*Primary Examiner*—Ernest R. Purser

*Attorney, Agent, or Firm*—J. Harold Nissen

[57] ABSTRACT

In the method of mining mineral deposits with hydraulic extraction a seam to be mined is divided into long pillars along the strike, and each pillar is subdivided with extraction workings and breakthroughs into benches defining short working faces, whereafter a single hydromonitor mounted in an extraction working is operated for stoping in the two adjacent benches, in the direction of the gravity flow of the slurry therealong. In accordance with the invention, boundary or run-around entries are driven, and communicated with the extraction workings via cut breakthroughs, whereafter these cut breakthroughs are expanded up to the sole of the seam, whereby at the stoping of the extraction cut in the two adjacent benches in the direction of the sloping of the extraction and boundary entries the main stream of the slurry is removed from the stope through the boundary working.

7 Claims, 4 Drawing Figures

METHOD OF MINING BEDDED MINERAL DEPOSITS WITH HYDRAULIC EXTRACTION

The invention relates to techniques of underground mining of bedded mineral deposits, and particularly it relates to methods of mining the mineral with hydraulic extraction and is intended for mining a seam with short working faces.

Known in the art is a method of mining mineral seams with hydraulic extraction, wherein a single hydromonitor is operated from one and the same position in one of the extraction workings for stoping a washing in two adjacent benches.

The method of preparation of the mining area in this case can be the panel or the level one, and the order of mining the level (panel) wing is a direct or inverted one.

The mineral seam is prepared for oncoming mining by providing an accumulating, a parallel and ventilating entries which are driven along the strike of the sloped seam ensuring a gravity flow of the slurry toward the hydraulic lift chamber. The accumulating and parallel entries are communicated with breakthrough headings, e.g. spaced by not less than 30 meters. In some cases the level is subdivided into several sublevels, to which end sublevel (intermediate) accumulating and parallel entries are provided along the strike of the seam, with the former accumulating entries of the worked upper sublevels being used as the ventilating entries.

A wing of a level or of a sublevel is divided into long pillars along the strike which, in their turn, are subdivided with extraction workings and air holes therebetween into two-bench mining bends (short pillars) extending strictly on the raise either diagonally or along the strike of the seam and defining short working faces.

The stoping of the mineral in the washing in adjacent benches is performed with hydromonitors from the extraction workings by consecutive making of washings in the direction of their sloping.

In the process of hydraulic extraction of the mineral in the stoping washing the produced slurry flows by gravity into the extraction working where the operating hydromonitor is mounted and where the team of its operators is. The slurry forms in the same place. This results in some discomfort of completing such operations as breaking of lumps, observing the completeness of stoping operations, hydromonitor operating etc.

Moreover, should a single air hole between a pair of adjacent extraction workings be closed off with caved rock of the seam roof, with a substantial distance between the hydromonitor and the functioning air hole, this might result in a high gas content at the stoping face because of an inadequate airing of it on account of the all-mine depression.

An important disadvantage of such a flowsheet is an increased loss of the mineral at stoping, with but a single working being available for visual assessment of the completeness of the mining. Moreover, the continuous presence of water in this sole working, which is the extraction one, impairs still further the quality of the visual assessment of the extraction completeness.

It is an object of the present invention to increase the output of a mineral by reducing its underground losses at stoping, and by improving the sanitary and hygienic conditions of labour.

It is another object of the present invention to provide a method of mining mineral seams with hydraulic extraction, which should provide for removing of the main stream of the slurry from the stoping face omitting the extraction working where the hydromonitor and its operating team are.

These and other objects are attained in a method of mining mineral seams with hydraulic extraction, wherein the seam being mined is divided into long pillars along the strike and each pillar is subdivided with extraction workings into two-bench extraction bends (short pillars) defining short working faces, whereafter the same hydromonitor mounted in the extraction working is operated for stoping a washing in the two adjacent benches in the direction of the gravity flow of the slurry therealong, in which method, in accordance with the invention, boundary workings are driven parallel to the extraction workings and communicated therewith via cut breakthroughs, whereafter these cut breakthroughs are expanded down to the floor of the seam, whereby at every stoping of a washing in the two adjacent benches in the direction of the sloping of the extraction workings and of the boundary one, the main slurry flow is removed therefrom through the boundary working omitting the extraction one.

This provides for an increased output and labour productivity owing to its reduced loss of the mineral underground at stoping, and also for an improvement of safety and hygienic labour conditions.

It is expedient that the spacing of the above-named adjacent cut breakthroughs should be set within the width of a single stoping washing.

The present invention will be further described in connection with the embodiment thereof, with reference being had to the accompanying drawings, wherein.

The herein disclosed method of mining mineral seams with hydraulic extraction resides in the following.

Figure 1:
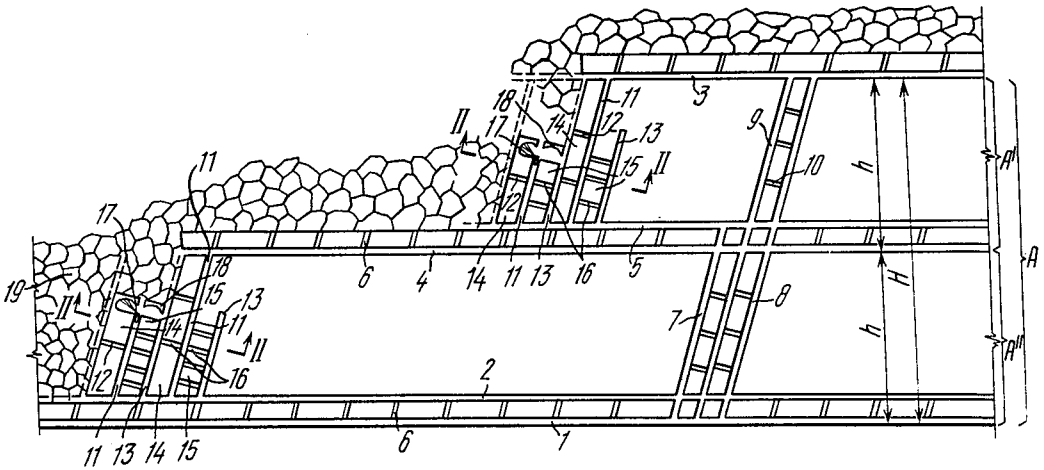
FIG. 1 shows schematically a general view of a system of mining a mineral seams with hydraulic extraction, in the plane of the seam, e.g. with diagonally extending rise workings and the stoping on-dip, in accordance with the invention.

An area of a mineral seam to be mined by hydraulic underground extraction is prepared for stoping work at first. The preparation includes dividing the area along either on-dip or on the raise of the seam into levels A with the inclined height H (FIG. 1), by running level accumulating entries 1, parallel entries 2 and ventilating entries 3. The levels A are divided, in their turn, into sublevels A′, A″ with the inclined height by running sublevel accumulating entries 4 and parallel entires 5. All the abovesaid entries are run along the strike of the seam at a sloping angle providing for gravity flow of the slurry toward the hydraulic lift chamber. Breakthrough entries 6 are run to interconnect the storage drifts 1, 4 and the parallel entries 2, 5, with spacing stipulated by safety regulations. For the ventilating entries 3, the former accumulating entries 1, 4 of the worked sublevels A′, A″ and levels A are used.

To establish communication between the workings of the sublevels A', A" and the level accumulating entry 1 and the ventilating entry 3, some rise, e.g. diagonal workings are provided in pairs, one of them being used as a slurry downflow heading 7 for passing down the slurry from the upper sublevel into the level accumulating entry 1; the other heading 8 running the entire height of the level A is used for auxiliary material lifting/lowering operations; the third heading 9 likewise running the entire height of the level A is used for personnel lifting/lowering operations. The rise workings are interconnected with ventilating breakthrough 10.

It is necessary to note that the rise workings are driven diagonally in the seam pitching at more than 18°. Although but two sublevels A', A" are shown in the appended drawing, FIG. 1, it is understood that a level can be subdivided into a greater number of sublevels.

It should be also pointed out that the herein disclosed method of mining mineral seams with hydraulic extraction can be employed by other mining systems, and patterns of preparing a seam for stoping operations.

Figure 2:
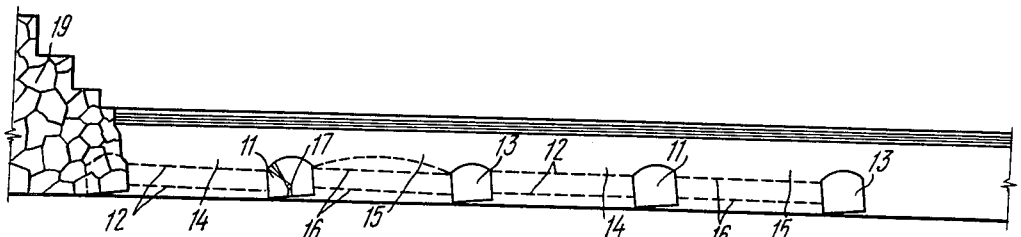
FIG. 2 is a sectional view taken on line II—II of FIG. 1, in accordance with the invention.
Figure 3:
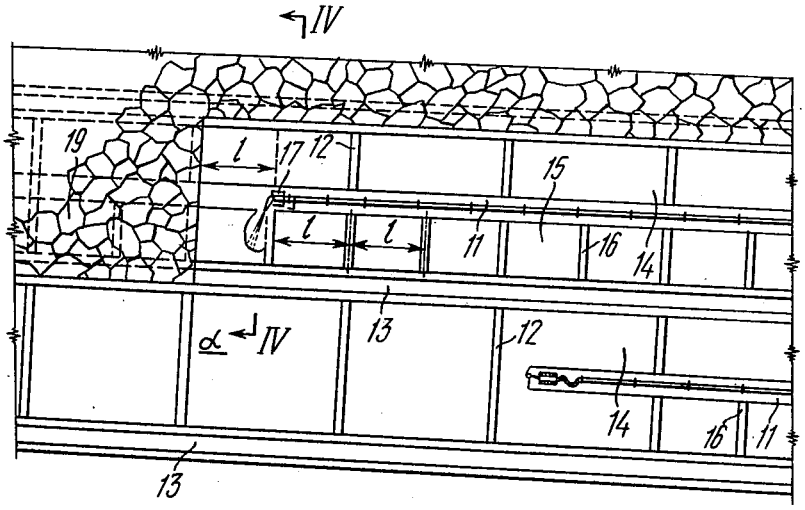
FIG. 3 is a fragmentary schematic view of the system of mining thick flat seams of a mineral with hydraulic extraction, in the plane of the seam, with the tailoring workings (extraction and boundary ones) and the stoping extending along the strike, in accordance with the invention.
Figure 4:
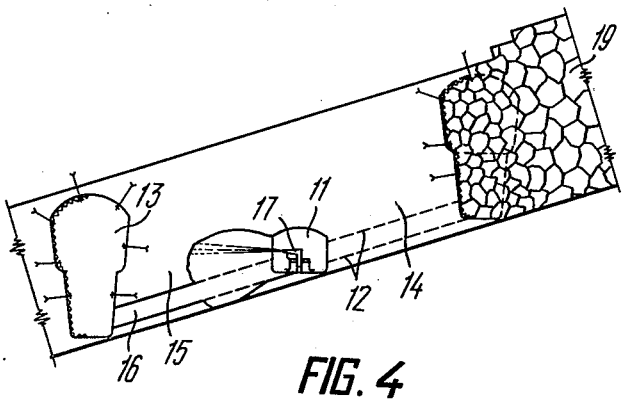
FIG. 4 is a sectional view taken on line IV—IV of FIG. 3, in accordance with the invention.

With all the preparatory workings run, the stoping work is commenced from the boundary of a wing of a level (sublevel), it being essential that the stoping in upper sublevels should run ahead of the stoping in the next lower sublevels, the seam of the mineral being extracted in the level (sublevel) is subdivided into two-bench extraction bends (short pillars), e.g. extending either diagonally (FIGS. 1, 2) along the strike (FIGS. 3, 4).

In each such an extraction pillar (bend) single extraction working 11 is driven, these workings being connected with the similar workings of the adjacent pillars (bends) with air holes 12 spaced by a distance, preferably, not short of 30 meters.

Furthermore, there is provided in each extraction pillar (bend) another boundary working 13. These boundary workings 13 are parallel to the extraction workings 11, and define in pairs therewith the accurately outlined, upper benches 14 and their adjacent lower benches 15. When thick flat seams of the mineral are mined, in certain cases the boundary workings 13 are made with the height substantially in excess of that of the extraction workings 11 (FIGS. 3, 4). This is being done to define a clearer borderline between the adjacent pillars along the thickness (the height) of the seam which provides for more complete stoping extraction.

The lower benches 15, in their turn, are cut with through-going cut breakthroughs 16. The spacing therebetween is set within the width "l" of a single stoping washing.

The stoping of the mineral is performed with aid of the hydromonitor 17 mounted in the extraction working 11, with commencing the stoping with expanding in the lower bench 15 the cut breakthrough 16 down to the floor of the seam, in each stoping washing whereby unopposed flow of the slurry from both adjacent benches 14 and 15 of the washing being mined into the boundary working 13 omitting the extraction working 11 is provided for. This enables to rid the extraction working 11 where the hydromonitor 17 and the personnel operating it are situated of the main and intense flow of the slurry, in which better sanitary and hygienic conditions of labour are ensured, and the safety of operation is enhanced.

Following the expansion of the cut breakthrough 16 in the next stoping washing down to the floor of the seam, the lower bench 15 is partly mined, and the jet of the hydromonitor 17 is provided for the extraction of the upper bench 14, while leaving about the contour of the lower bench 15 on the gob side the temporary production-wise pillars 18 which are mined in the last turn, following the mining of the upper bench 14 of the stoping washing. This completes the stoping of the two benches of the stoping washing and the hydromonitor 17 is displaced along the extraction working 11 to a new position for mining of the next stoping washing, and so on.

Simultaneously with the stoping hydromining, the next pillar is tailored.

With the stoping advance in the direction of the gravity flow of the slurry along the boundary working 13, the hydromonitor 17 retreats along the extraction working 11 to ever newer positions, while the worked-out area of the pillar being mined is self-filled with the caved rock 19 of the seam roof.

Therefore, in accordance with the herein disclosed method, owing to the slurry flow being redirected at the stoping into the boundary working 13, the extraction working 11 where the hydromonitor 17 and persons operating it are situated is rid of the slurry flow.

Furthermore, owing to the provision of the through-going cut breakthroughs 16 which are relatively closely spaced, i.e. their spacing is equal to or short of the width "l" of the stoping washing, the spare ways from the extraction working 11 into the boundary working 13 and back can be closer to one another, which substantially facilitates the airing owing to the all-mine depression of the entire mining area, and particularly of those sections thereof where the people operating the hydromonitor are situated. Besides, the provision of an extra boundary working 13 in the mining bend (pillar) being mined—offers additional visual assessment and improved control of the completeness of the stoping work.

All the above features are reflected in a greater output of the mineral and in an increase of the labour productivity.

What is claimed is:

1. A method of mining bedded mineral deposits with hydraulic excavation, including dividing a bed to be mined into long pillars extending along the strike by means of dividing accumulating, parallel and ventilating entires as well as rise workings for slurry flowing-down material lifting and gang ways on the rise;

running extraction workings in each said pillar and interconnecting said pillars with air holes;

providing boundary workings, parallel to said extraction workings and connecting them therewith with cut breakthroughs, with the distance between adjacent cut breakthroughs being set within the width of a single stop washing;

expanding said cut breakthroughs down to the seam floor;

providing workings in the long pillar being mined along the strike two-bench mining bends (short pillars) defining short working faces;

setting a hydromonitor in an invariable position in said extraction working to produce a hydromonitor jet;

hydraulically extracting the mineral in two directions from each stope washing in both adjacent benches, in the direction of the gravity by flowing of a slurry of water and the mined mineral along the working commencing with the expanding of the cut breakthrough in the lower bench down to the seam floor; and removing the main stream of the slurry from the stope washings via said boundary workings omitting the extraction ones.

2. The method as claimed in claim 1 including extracting the slurry from two sides.

3. The method as claimed in claim 1 or 2, including providing of air holes between the boundary workings and the extraction workings and widening them to allow the free passage of the slurry.

4. The method as claimed in claim 2 including visually assessing and controlling the completeness of the stoping work through the boundary workings.

5. The method as claimed in claim 1 or 2 including passing down the slurry from an upper sublevel into the level accumulating entry through a first heading performing lifting/lowering operations through a second heading, and performing personnel lifting/lowering operations through a third heading.

6. The method as claimed in claim 5, including ventilating between the second heading and the third heading.

7. The method as claimed in claim 1, including flowing the slurry downstream of the hydromonitor jet and in the presence of an additional exposed plane.

* * * * *

UNITED STATES PATENT AND TRADEMARK OFFICE

CERTIFICATE OF CORRECTION

PATENT NO. : 4,199,192

DATED : April 22, 1980

INVENTOR(S) : Boris P. Odinokov et al

It is certified that error appears in the above–identified patent and that said Letters Patent are hereby corrected as shown below:

Col. 4, Line 55 "stop" should be --stope--

Signed and Sealed this

*Twenty-third* Day of *September 1980*

[SEAL]

*Attest:*

SIDNEY A. DIAMOND

*Attesting Officer*

*Commissioner of Patents and Trademarks*